US010222730B2

(12) United States Patent
Kurahashi

(10) Patent No.: US 10,222,730 B2
(45) Date of Patent: Mar. 5, 2019

(54) IMAGE FORMING APPARATUS USING DETACHABLE FIXING UNIT THAT FIXES TONER BY HEATING PAPER AFTER TONER PATTERN IS TRANSFERRED

(71) Applicant: KYOCERA Document Solutions Inc., Osaka (JP)

(72) Inventor: Taro Kurahashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/986,809

(22) Filed: May 23, 2018

(65) Prior Publication Data

US 2018/0364626 A1 Dec. 20, 2018

(30) Foreign Application Priority Data

Jun. 20, 2017 (JP) ..... 2017-120265

(51) Int. Cl.
*G03G 15/20* (2006.01)
*G03G 21/16* (2006.01)
*G03G 21/18* (2006.01)

(52) U.S. Cl.
CPC ..... *G03G 15/2035* (2013.01); *G03G 21/1652* (2013.01); *G03G 21/1871* (2013.01); *G03G 21/1685* (2013.01); *G03G 2221/1639* (2013.01)

(58) Field of Classification Search
CPC ..... G03G 15/2035; G03G 15/2071; G03G 21/1685; G03G 21/1652; G03G 21/1871; G03G 2221/1639
See application file for complete search history.

(56) References Cited

U.S. PATENT DOCUMENTS

2008/0298824 A1* 12/2008 Kanno ..... G03G 15/2039 399/33
2009/0232550 A1 9/2009 Obata
2017/0068212 A1* 3/2017 Nanai ..... G03G 21/1889

FOREIGN PATENT DOCUMENTS

JP 2012233987 A * 11/2012
JP 5339750 B 8/2013
JP 2016-071134 A 5/2016

OTHER PUBLICATIONS

JP2012233987 english translation Asaka Published Nov. 29, 2012 (Year: 2012).*

* cited by examiner

*Primary Examiner* — Ryan D Walsh
(74) *Attorney, Agent, or Firm* — Hawaii Patent Services; Nathaniel K. Fedde; Kenton N. Fedde

(57) ABSTRACT

Provided is an inexpensive image forming apparatus that reduces wasteful operation and is capable of determining whether a fixing unit is attached properly. The image forming apparatus includes an image forming apparatus main body, and a fixing roller that fixes a pattern composed of toner on paper by heating when conveying the paper on which the pattern is formed, and uses a fixing unit that can be attached to and detached from the image forming apparatus main body. A temperature sensor for detecting the temperature of the fixing roller is provided in the fixing unit. The image forming apparatus includes a control unit that, after the fixing unit is attached, determines whether or not the fixing unit is attached properly to the image forming apparatus main body according to a magnitude relationship between the temperature detected by the temperature sensor and a preset first threshold value.

9 Claims, 5 Drawing Sheets

IMAGE FORMING APPARATUS USING DETACHABLE FIXING UNIT THAT FIXES TONER BY HEATING PAPER AFTER TONER PATTERN IS TRANSFERRED

INCORPORATION BY REFERENCE

This application is based on and claims the benefit of priority from Japanese Patent Application No. 2017-120265 filed on Jun. 20, 2017, the contents of which are hereby incorporated by reference.

BACKGROUND

The present disclosure relates to an image forming apparatus that uses a detachable fixing unit that fixes toner by heating paper after a toner pattern is transferred.

In an image forming apparatus such as a printer and the like, an image pattern that is composed of toner is first formed on a photosensitive drum, and after this image pattern is transferred to paper (a medium), the image pattern is fixed to the paper by a fixing roller that is maintained at a high temperature. When doing this, fixing the toner to the paper is performed while the paper is nipped and conveyed between a fixing roller and pressure roller. Degradation of the fixing roller and the like may occur over time, or paper may become jammed inside the fixing unit (paper jam may occur). Therefore, the fixing roller and the pressure roller are provided inside a fixing unit, and the fixing unit is normally configured so that the fixing unit can be attached to or detached from the main body of the image forming apparatus, and so that the work of attaching or detaching the fixing unit can be performed easily by a user.

In the fixing unit, in order to stably perform a fixing operation such as described above, normally a specified pressure is set to be applied between the pressure roller and the fixing roller. However, the fixing unit is configured so that when handling in case of the occurrence of a paper jam such as described above, or in order to perform various kinds of maintenance, a state can be set in which this pressure is greatly reduced from the normal pressure (released-pressure state). Moreover, a heater, a temperature sensor and the like are provided in the fixing roller in order to maintain the temperature of the fixing roller within a specific high-temperature range, and a connector for supplying electric power to the heater, temperature sensor and the like, or for exchanging electric signals between them is provided between the fixing unit and the main body.

In addition, the fixing roller and the like in the fixing unit may be mechanically driven from the main body side. Furthermore, switching states (normal state, released-pressure state) between the fixing roller and the pressure roller as described above may be performed by a motor for switching the pressure that is provided on the main body side. In order to properly operate this kind of fixing unit, it is necessary that the fixing unit be attached properly to the main body. When a user operates the image forming apparatus in a state in which this fixing unit is not attached properly (incomplete state), the alignment between the main body side and the fixing unit side of the image forming apparatus is lost. Therefore, image defects, paper jams, and the like may occur, and furthermore, damage to the fixing unit or the main body of the image forming apparatus may occur.

Therefore, the image forming apparatus is configured so as to recognize whether or not the fixing unit is attached properly to the main body, and when the fixing unit is not attached properly, disables operation of the image forming apparatus. Various kinds of sensors are necessary in order to determine whether or not the fixing unit is attached properly. However, in a typical image forming apparatus, sensors that are originally provided for other purposes are also used for determining whether or not the fixing unit is attached properly.

More specifically, sensors for this purpose, a pressure-release sensor (pressure-release-detection flag) and a fixing-conveyance sensor (transfer-material-detection flag) are used. The pressure-release sensor detects the state of the pressure between the fixing roller and the pressure roller (normal state (high pressure), released-pressure state (low pressure)). The fixing-conveyance sensor detects when the paper passes between the fixing roller and the pressure roller.

Specifically, the pressure-release sensor is an optical sensor that rotates according to change in the state between the fixing roller and pressure roller such as described above, and in the normal state detects that light is transmitted, and in the released-pressure state, detects that light is blocked.

The fixing-conveyance sensor, in order to determine whether or not the fixing operation on the paper is complete, detects whether or not the paper is directly below the fixing roller and the pressure roller. As the fixing-conveyance sensor an optical sensor that is the same as the pressure-state sensor is used. The sensor is set so that when there is paper (when the fixing operation is being performed), the sensor detects that light is transmitted, and when there is no paper (the fixing operation is finished), the sensor detects that light is blocked.

In this way, neither the pressure-release sensor nor the fixing-conveyance sensor is originally provided for determining whether or not the fixing unit is attached properly. However, a typical image forming apparatus is structured so that these sensors can also be used in determining whether or not the fixing unit is attached properly, and the pressure-release sensor and the fixing-conveyance sensor are provided at positions that are separated from each other. Therefore, at each location, it is particularly possible to determine whether or not the positional relationship between the fixing unit and the main body is proper. Consequently, it is not necessary to provide a new sensor for determining whether or not the fixing unit is attached properly, and so the image forming apparatus can be made inexpensively.

When the pressure-release sensor and the fixing-conveyance sensor are set as described above, and when both the pressure-release sensor and the fixing-conveyance sensor are in a state in which light is blocked, it is determined that the fixing unit is attached properly. Moreover, when one of the pressure-release sensor and the fixing-conveyance sensor is in a state in which light is transmitted, it is determined that the fixing unit is not attached properly on the side of that sensor. Furthermore, when both sensors are in a state in which light is transmitted, it is determined that the fixing unit is not attached properly on either side.

SUMMARY

The image forming apparatus according to the present disclosure includes an image forming apparatus main body, and a fixing roller that fixes a pattern composed of toner on paper by heating when conveying the paper on which the pattern is formed. Moreover, the image forming apparatus uses a fixing unit that can be attached to and detached from the image forming apparatus main body. A temperature sensor for detecting the temperature of the fixing roller is provided in the fixing unit. The image forming apparatus includes a control unit that, after the fixing unit is attached, determines whether or not the fixing unit is attached properly to the image forming apparatus main body according to a magnitude relationship between the temperature detected by the temperature sensor and a preset first threshold value.

DETAILED DESCRIPTION

Figure 1:
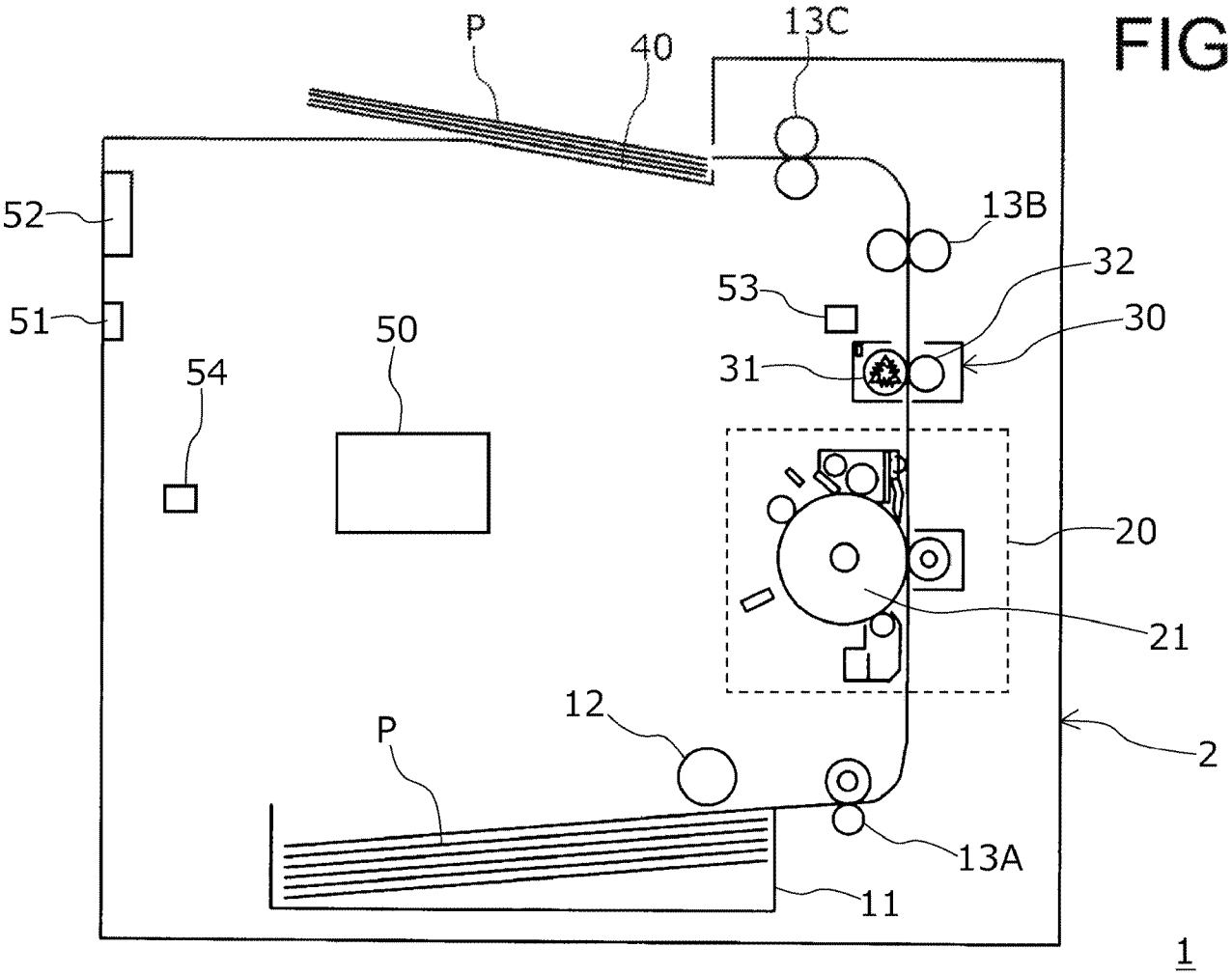
FIG. 1 schematically illustrates the configuration of an image forming apparatus of an embodiment according to the present disclosure.

In the following, embodiments according to the present disclosure will be explained with reference to the drawings. FIG. 1 is a diagram that illustrates the configuration of this image forming apparatus 1 in a simplified manner. In this image forming apparatus 1, paper P that is stored in a paper-supply cassette 11 is conveyed by a pickup roller 12 and conveying roller 13A, and is conveyed to an image-forming unit 20 that includes a photosensitive drum 21 and the like. In the image-forming unit 20, an image pattern that is composed of toner is formed on the photosensitive drum 21 by electrostatic force, when the paper P is conveyed upward in FIG. 1, the image pattern is transferred to the paper P. The configuration of the image-forming unit 20 is the same as that of a well-known image forming apparatus. Moreover, this image forming apparatus 1 performs monochrome output, so in the example illustrated in FIG. 1 a single image-forming unit 20 (photosensitive drum 21) that corresponds to the color black is provided. In the case of outputting a color image, configuration is such that plural image-forming units for each color are provided, and image patterns that are formed for each color by each of the image-forming units are transferred to the same paper P.

The paper P to which the image pattern composed of toner is transferred is nipped by the fixing roller 31 and the pressure roller 32 and conveyed on the upper side. At this time, the temperature of the fixing roller 31 is controlled to be within a specified high-temperature range, and the pressure roller 32 is pressed to the fixing roller 31 side at a specified pressure. As a result, the image pattern that is transferred onto the paper P is fixed to the paper P. After that, the paper P is conveyed by the conveying rollers 13B, 13C and discharged by the paper-discharge unit 40 on the upper side. The fixing roller 31 and the pressure roller 32 are provided in a detachable fixing unit 30. The configuration of the fixing unit 30 will be described later.

Moreover, in this image forming apparatus 1, in order to smoothly perform the operation described above, a control unit 50 that is a CPU for controlling each of the aforementioned units is provided. A user, by operating plural operation keys of an operation panel 51 that is provided on the uppermost portion, causes the control unit 50 to perform various kinds of instructions. When doing this, the control unit 50 can cause the display unit 52 that is a display to display various kinds of information, or display warnings to the user.

In the following, the image forming apparatus main body 2 is formed by integrating the components other than the paper P and the fixing unit 30 in the configuration of FIG. 1. Actually, in the image forming apparatus main body 2 there are also detachable components similar to the fixing unit 30, however, those components are not related to the present disclosure, so in the following it is presumed that only the fixing unit 30 can be attached to or detached from the image forming apparatus main body 2.

Figure 2:
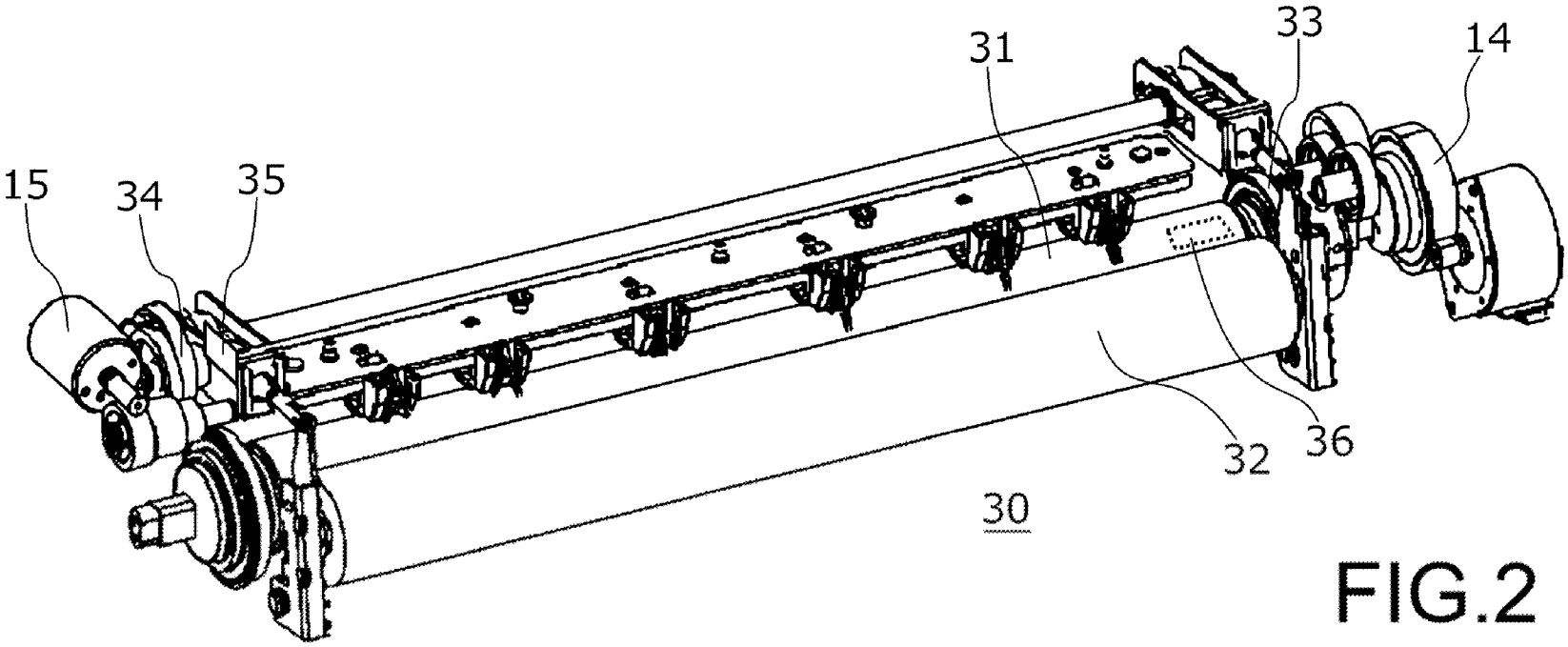
FIG. 2 is a perspective view illustrating a fixing unit that is used in an image forming apparatus of an embodiment according to the present disclosure.

FIG. 2 is a perspective view illustrating the structure of the fixing unit 30. As described above, in this fixing unit 30, the long, thin cylindrical-shaped fixing roller 31 and pressure roller 32 are mounted so that the axes of rotation are parallel with each other, and so that the surfaces come in contact. On the right side in FIG. 2, a roller-rotating mechanism 33 is provided that rotates the fixing roller 31 by being driven from the image forming apparatus main body 2 when the fixing unit 30 is attached, and the pressure roller 32 follows the rotation of the fixing roller 31.

Moreover, as described above, the pressure roller 32 is pressed to the fixing roller 31 side, and the pressure between these rollers can be switched between two stages; high pressure (normal state) and low pressure (released-pressure state). This switching operation is also driven from the image forming apparatus main body 2 side, and in order for this, a pressure-releasing mechanism 34 is provided in the fixing unit 30 as illustrated on the left side of FIG. 2. In the pressure-releasing mechanism 34, an eccentric cam rotates by being driven from the image forming apparatus main body 2 side, and as a result, the relative position of the pressure roller 32 with respect to the fixing roller 31 is finely adjusted, which switches the aforementioned pressure. During this operation, the direction of rotation of the eccentric cam is fixed, and when rotated, alternately switches between the normal state and the release pressure state.

Incidentally, in FIG. 2, a roller-driving mechanism 14 that drives the roller-rotating mechanism 33 from the image forming apparatus main body 2 side, and a pressure-release-driving mechanism 15 that drives the pressure-releasing mechanism 34 from the image forming apparatus main body 2 side are illustrated for convenience. As described above, the roller-driving mechanism 14 and the pressure-release-driving mechanism 15 are actually provided on the image forming apparatus main body 2 side, and the control of these mechanisms is performed by the control unit 50. Therefore, driving the fixing roller 31 and switching between the normal state and the released-pressure state in the fixing unit 30 can be controlled by the control unit 50.

Furthermore, a pressure-release sensor 35 for detecting whether, as described above, the fixing unit 30 is in the normal state (high pressure between the fixing roller 31 and the pressure roller 32), or in the released-pressure state (low pressure between the fixing roller 31 and the pressure roller 32) is particularly mounted in the pressure-releasing mechanism 34. As the pressure-release sensor 35, an optical sensor that is set so as to be switched between transmitting light and blocking light by the operation of the aforementioned eccentric cam is used.

Here, in this fixing unit 30, in the initial state (for example, a state in which the fixing unit 30 is not attached), the fixing unit 30 is set so as to be in the normal state (high pressure between the fixing roller 31 and the pressure roller 32). This state is also maintained directly after the user attaches the fixing unit 30 to the image forming apparatus main body 2. Then, in order to set the fixing unit 30 to the released-pressure state (state of low pressure between the fixing roller 31 and the pressure roller 32), an operation for driving the pressure-releasing mechanism 34 by the pressure-release-driving mechanism 15 from the image forming apparatus main body 2 side is necessary.

In addition, a heater and a temperature sensor (thermistor) 36 are provided inside the fixing roller 31. The temperature sensor 36 is provided inside a portion near the end section of the fixing roller 31. By supplying electric power to the heater from the image forming apparatus main body 2 side, the temperature of the fixing roller 31 can be maintained at high temperature. Moreover, by electrically connecting the temperature sensor 36 to the control unit 50 on the image forming apparatus main body 2 side, the control unit 50 recognizes the actual temperature of the fixing roller 31, controls the heater by using that temperature as feedback, and can maintain the temperature of the fixing roller 31 within a specified high-temperature range. Alternatively, as will be described later, other control can also be performed based on the temperature that is detected by the temperature sensor 36. In order for this, a fixing unit side connector for connecting the wiring connected to the heater, pressure-release sensor 35, and temperature sensor 36 with the image forming apparatus main body 2 side is provided on the fixing unit 30 side. A main body side connector for engaging with the fixing unit side connector is provided on the image forming apparatus main body 2 side.

The state in this image forming apparatus 1 in which the fixing unit 30 is attached properly to the image forming apparatus main body 2 will be explained. This state means a state in which the roller-rotating mechanism 33 and pressure-releasing mechanism 34 are properly engaged with the roller-driving mechanism 14 and pressure-release-driving mechanism 15 on the image forming apparatus main body 2 side, respectively, and the fixing unit side connector is properly engaged with the main body side connector. As a result, the aforementioned operation on the fixing unit 30 side, or proper control of the fixing unit 30 by the control unit 50 becomes possible.

Moreover, separate from the aforementioned temperature sensor 36, a main body side temperature sensor (thermistor) 53 capable of measuring temperature is provided in the vicinity of the fixing roller 31 when the fixing unit 30 is attached properly. As described above, the temperature sensor 36 is provided near the end section in the lengthwise direction of the fixing roller 31, however, this main body side temperature sensor 53 is provided near the center portion in the lengthwise direction of the attached properly fixing roller 31. Therefore, the control unit 50 can recognized the temperature at different locations in the fixing roller 31 by the temperature sensor 36 and the main body side temperature sensor 53. Furthermore, an outside-air temperature sensor (thermistor) 54 for detecting the outside-air temperature of the surrounding environment where the image forming apparatus 1 is installed is also provided in the image forming apparatus main body 2. Conversely to the aforementioned main body side temperature sensor 53, the outside-air temperature sensor 54 is provided at a location separated from the fixing unit 30 so as to not be affected by the temperature of the fixing roller 31 when the fixing unit 30 is attached.

In this image forming apparatus 1, immediately after the fixing unit 30 is attached to the image forming apparatus 2, the fixing unit 30 is controlled as explained below, and whether or not the fixing unit 30 is attached properly is determined. This is performed before the control unit 50 causes the fixing unit 30 to perform the original operation of performing the fixing operation on the paper P. When it is determined that the fixing unit 30 is not attached properly, the control unit 50 causes that fact to be displayed by the display unit 52.

Figure 3:
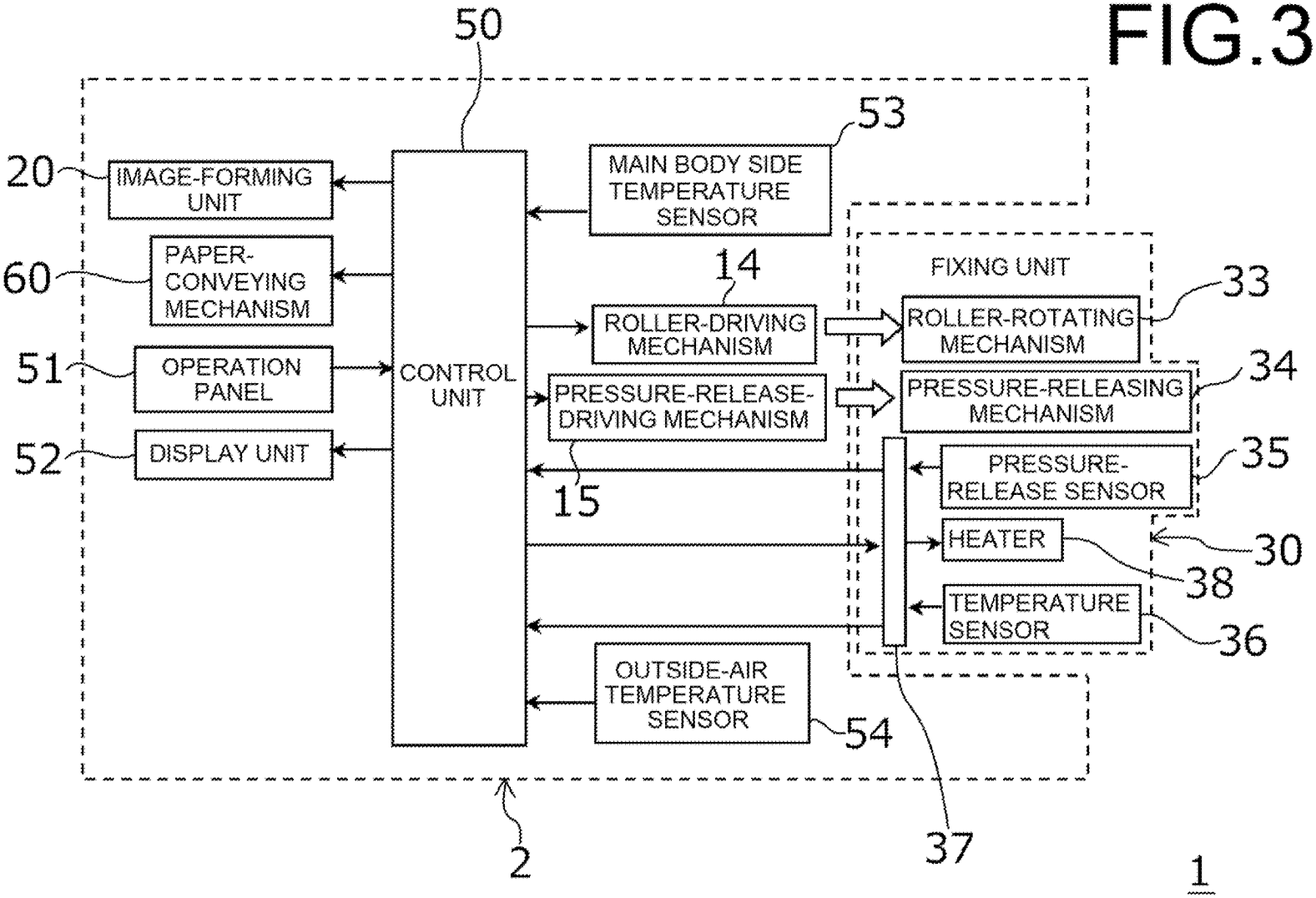
FIG. 3 is a block diagram of a portion related to control of an image forming apparatus of an embodiment according to the present disclosure.
Figure 4:
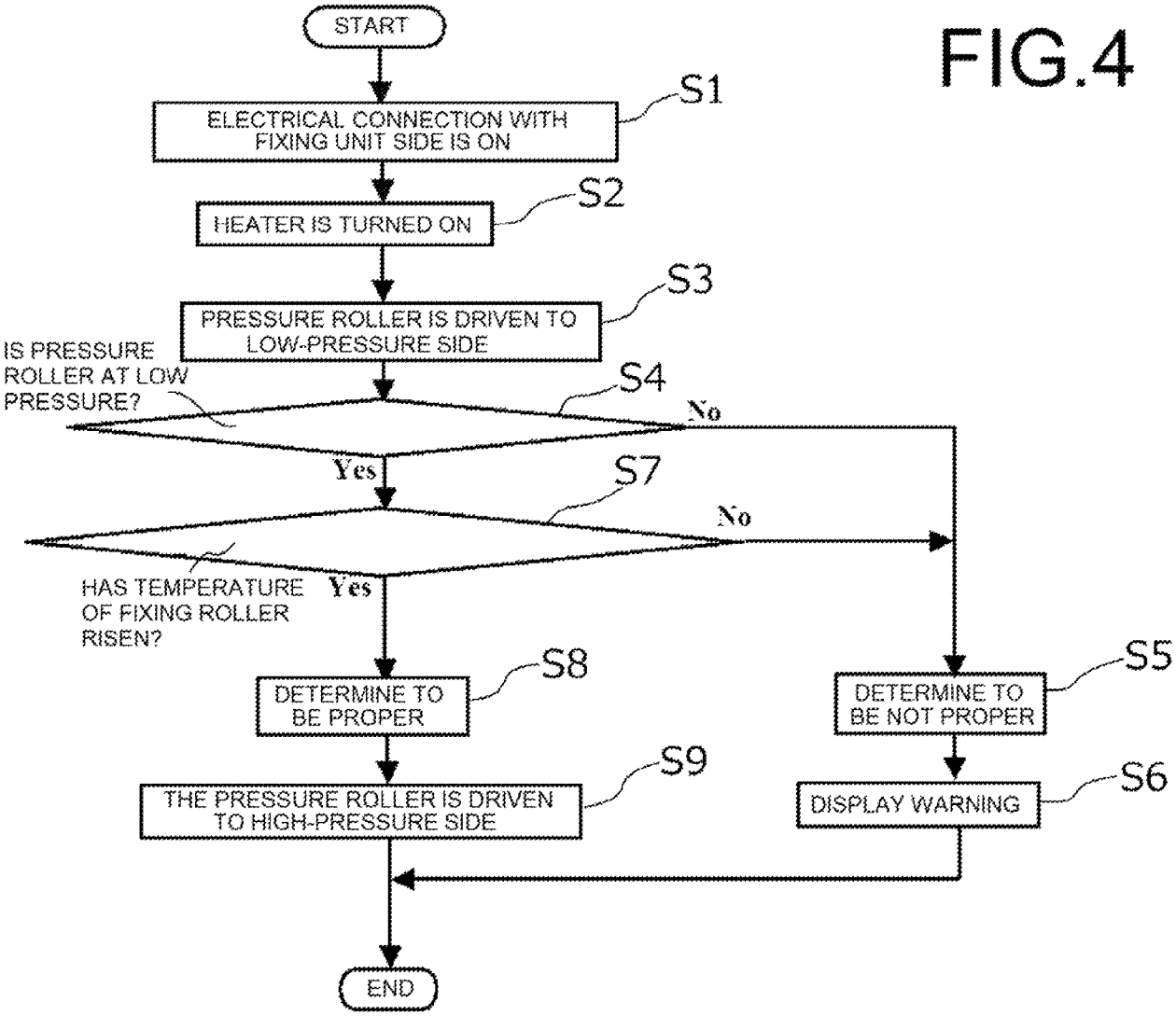
FIG. 4 is the first of two flowcharts of the operation performed when determining whether or not a fixing unit is attached properly to an image forming apparatus of an embodiment according to the present disclosure.

FIG. 3 is a block diagram illustrating configuration related to the control of the image forming apparatus 1 at this time, and FIG. 4 is a first of two flowcharts illustrating the operation by the control unit 50. Incidentally, in FIG. 3, the various rollers (pickup roller 11, conveying roller 13A and the like) that are used for conveying the paper P in the image forming apparatus main body 2 are illustrated as a paper-conveying mechanism 60. In FIG. 3, a fixing unit side connector 37 in the fixing unit 30, and a heater 38 inside the fixing roller 31 are also illustrated. In FIG. 4, the operation immediately after the fixing unit 30 is attached to the image forming apparatus main body 2 is illustrated. Therefore, this operation is performed before the normal operation of the fixing unit 30 (fixing an image onto the paper P).

First, when the fixing unit 30 is attached, the fixing unit side connector 37 and the main body side connector are connected, and these connectors are electrically connected (S1). As a result, the control unit 50 performs control of the electric current that flows to the heater 38 on the fixing unit 30 side (S2). In doing so, when the electrical connection is properly performed, the temperature of the fixing roller 31 rises, however, actually a certain amount of time is required for this temperature to rise.

Moreover, at this time, as described above, the fixing unit 30 is in the normal state. Therefore, next, the control unit 50 drives the pressure-releasing mechanism 34 on the fixing unit 30 side to the pressure release side (S3). The control unit 50, by the pressure-release sensor 35, can recognize after that whether or not the state actually becomes the released-pressure state (S4). When it is not recognized by the pressure-release sensor 35 that the state has become the released-pressure state (S4: NO), it is determined that the pressure-releasing mechanism 34 or the pressure-release sensor 35 is not operating properly. Therefore, the control unit 50 determines that the fixing unit 30 is not attached properly (S5), and causes that fact to be displayed by the display unit 52 (S6).

On the other hand, when it is confirmed that the state is the released-pressure state (S4: YES), next, whether or not the temperature detected by the temperature sensor 36 has risen due to the heater 38 is determined (S7). Here, when it is determined that the temperature has risen, whether or not the detected temperature is equal to or greater than threshold value (first threshold value) that is greater than room temperature can be determined. Here, when it is determined that this temperature has not risen (S7: NO), it is determined that the electrical connection with the heater 38 or the temperature sensor 36 is not proper. Therefore, the control unit 50 determines that the fixing unit 30 is not attached properly (S5), and causes that fact to be displayed by the display unit 52 (S6).

When it is determined that the temperature has risen (S7: YES), it is recognized that the heater 38 and temperature sensor 36 are operating properly. Therefore, by also taking into consideration that the pressure-releasing mechanism 34 is properly operating as described above (S4: YES), the control unit 50 determines that the fixing unit 30 is attached properly. (S8). In this case, the control unit 50 drives the pressure-releasing mechanism 34 so that the state becomes the normal state again (S9). As a result, the fixing unit 30 can be used to fix an image pattern on the paper P.

Incidentally, as described above, the normal state and released-pressure state in the pressure roller 32 are alternately switched by the rotation of an eccentric cam. Therefore, during determination by the pressure-release sensor 35 (S4), preferably the state is recognized as being the released-pressure state (S4: YES) even when the state temporarily becomes the released-pressure state. Moreover, determination of whether or not the temperature has risen (S7) may be set to be performed after a specified amount of time has elapsed after electric current begins to flow to the heater 38 (S2).

Also in the image forming apparatus 1 described above, the pressure-release sensor 35 and temperature sensor 36 that are provided for another purpose are used for determining whether or not the fixing unit 30 is attached properly instead of special parts that are provided for this determination. In other words, whether or not the fixing unit 30 is attached properly can be determined using simple configuration, and so the image forming apparatus 1 can be made inexpensively.

However, in the determination that is used in the operation described above, whether or not there is paper P near the fixing roller 31 is irrelevant. Therefore, driving the fixing roller 31 (roller-rotating mechanism 33) is not necessary for the determination described above, and only driving the pressure-releasing mechanism 34 for a short period of time is required. Moreover, supplying electric power to the heater 38 and detecting the temperature by the temperature sensor 36 are not operations that are performed just for determining whether or not the fixing unit 30 is attached properly, but are operations that are always performed in this image forming apparatus 1. Therefore, the image forming apparatus 1 described above can determine whether or not the fixing unit 30 is attached properly while also reducing unnecessary operation.

Incidentally, opposite to that described above, the initial state of the fixing unit 30 may be the released-pressure state. In this case, driving the pressure-releasing mechanism 34 described above (S3) may be set to the normal state side, and the normal state may be recognized by the pressure-release sensor 35 (S4).

In the flowchart illustrated in FIG. 4, the pressure-release sensor 35 and temperature sensor 36 are used in the determination of whether or not the fixing unit 30 is attached properly. Here, the main body side temperature sensor 53 that is provided on the image forming apparatus main body 2 side can also further be used in the determination of whether or not the fixing unit 30 is attached properly. Particularly, the case will be explained in which the main body side temperature sensor 53 is arranged sufficiently close to the fixing roller 31 when the fixing unit 30 is attached properly. In this case, the temperature that is detected by the main body side temperature sensor 53 can be set to approach the actual temperature of the fixing roller 31 (temperature detected by the temperature sensor 36) when the fixing unit 30 is attached properly. Moreover, the temperature that is detected by the main body side temperature sensor 53 can be set to deviate from the actual temperature of the fixing roller 31 when the fixing unit 30 is not attached properly.

Figure 5:
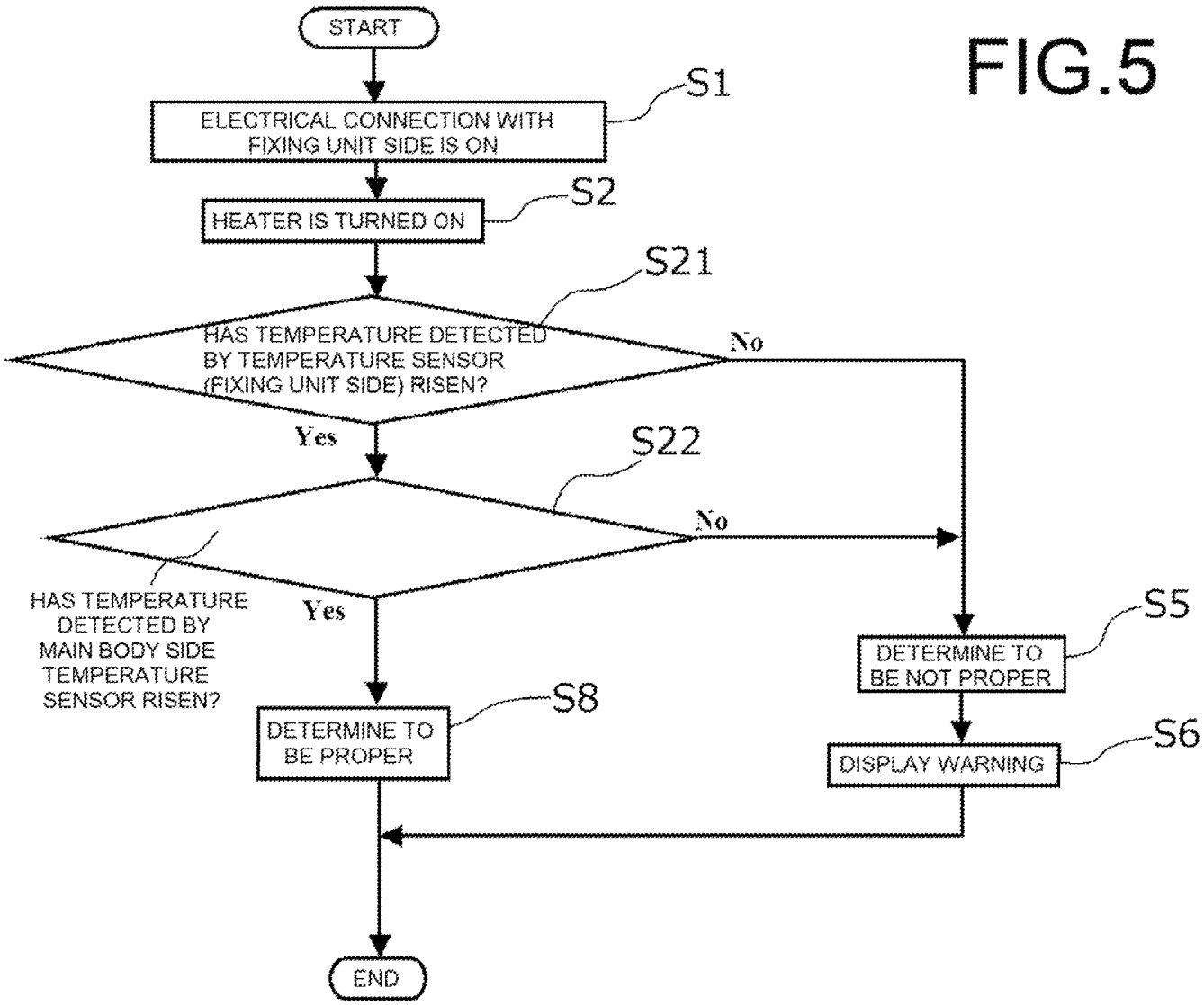
FIG. 5 is the second of two flowcharts of the operation performed when determining whether or not a fixing unit is attached properly to an image forming apparatus of an embodiment according to the present disclosure.

FIG. 5 is a second flowchart illustrating operation of the control unit 50 in this case. In this operation, after electric current flows to the heater 38 (S2), the fixing unit 30 is recognized as being attached properly (S2) only in the case described below (S8). This is a case when, first, a rise in temperature is recognized by the temperature sensor 36 on the fixing unit 30 side (S21: YES), and when a rise in temperature is recognized by the main body side temperature sensor 53 (S22: YES).

On the other hand, when a rise in temperature is not recognized by the temperature sensor 36 (S21: NO), or when a rise in temperature is not recognized by the main body side temperature sensor 53 (S22: NO), it is determined that the fixing unit 30 is not attached properly (S5). Incidentally, in the explanation above, the criteria for the main body side temperature sensor 53 to determine whether or not the temperature has risen (S22), as described above, can be determined whether or not the temperature detected by the main body side temperature sensor 53 is equal to or greater than a threshold value (second threshold value) that is higher than room temperature. The first threshold value for the temperature sensor 36, and the second threshold value for the main body side temperature sensor 53 can be set to different values.

In this operation, the pressure-release sensor 35 is not used, and the pressure-releasing mechanism 34 is not driven. Therefore, the power consumption when determining whether or not the fixing unit 30 is attached properly can be further reduced.

Incidentally, according to the flowcharts in FIG. 4 and FIG. 5, when it is recognized that the attaching is not proper (S5) and a warning (S6) is issued, the user attaches the fixing unit 30 again. In this case, the fixing unit 30 side may be faulty, or the image forming apparatus main body 2 side may be faulty. This occurs when, due to a faulty pressure-releasing mechanism 34 or pressure-release sensor 35, the released-pressure state (low pressure) is not set (S4: NO in FIG. 4), or when a rise in temperature cannot be confirmed by the temperature sensor 36 (S7: NO in FIG. 4, S21: NO in FIG. 5), or the like. In this case, the same result occurs even when the fixing unit 30 is reattached in this state. Therefore, for example, when the operations in the flowchart in FIG. 4 and FIG. 5 are performed multiple times and the attaching is continuously recognized as not being proper (S5), preferably the display unit 52 is made to display that there is some problem with the fixing unit 30 itself, or that there is some problem on the image forming apparatus main body 2 side.

Moreover, it is also possible to perform a setting that appropriately determines which of the operations in FIGS. 4 and 5 to perform. As the criteria for determining this, that outside-air temperature (temperature of the surrounding environment where the image forming apparatus 1 is installed) that is detected by the outside-air temperature sensor 54 can be employed. For example, when the outside-air temperature is low, the temperature of the image forming apparatus main body 2 before attaching is low, and a particularly long amount of time is required for the temperature of the main body side temperature sensor 53 to rise sufficiently (equal to or greater than the second threshold value) after the electric power is turned ON to the heater 38. Therefore, by performing the operation in FIG. 5 that uses only the detected temperature as determination criteria, there is a high possibility that the fixing unit 30 will be determined to not be attached properly (S5) regardless of whether the fixing unit 30 is attached properly. On the other hand, determination in the operation in FIG. 4 of whether or not the fixing unit 30 is in the released-pressure state (S4) is not related to the outside-air temperature. Therefore, in order to perform a proper determination when the outside-air temperature is low, the operation in FIG. 4 is preferred.

However, as described above, in the operation in FIG. 4, it is necessary to drive the pressure-releasing mechanism 34, so the power consumption becomes larger than in the case of performing the operation in FIG. 5. Therefore, the setting can be such that when the outside-air temperature detected by the outside-air temperature sensor 54 is high, the operation in FIG. 5 is performed, and when the outside-air temperature is low, the operation in FIG. 4 is performed. The temperature for switching this operation (third threshold value) can be set in consideration of the temperature dependence of the state in which error occurs in the determination of whether or not the fixing unit 30 is attached properly when the operation in FIG. 5 is performed.

For example, the operation by the image-forming unit 20 can also be optimized according to the outside-air temperature, and so the outside-air temperature sensor 54 can be used. Therefore, the outside-air temperature sensor 54 is not a part that is used only for determining whether or not the fixing unit 30 is attached properly.

Moreover, in the operation in FIG. 5, the pressure-release sensor 35 and the pressure-releasing mechanism 34 are not used. Therefore, the operation in FIG. 5 can also be applied to an image forming apparatus that does not have a pressure-releasing mechanism, or an image forming apparatus in which a fixing unit is used of which the pressure-releasing mechanism is not controlled from the image forming apparatus main body side. Furthermore, the operation in FIG. 5 can be applied when a fixing unit is used that has a temperature-controlled fixing roller, and that can be attached to or detached from the image forming apparatus main body.

Conversely, when the aforementioned determination by the pressure-release sensor (S4), determination by the temperature sensor (S7, S21), and determination by the main body side temperature sensor (S22) are all combined and are all YES, it can also be determined that the apparatus is proper. Alternatively, it is also possible to incorporate other elements as well; for example, the electric current that flows to the heater 38, and the like.

In the configuration of the typical technology described above, a pressure-release sensor and fixing-conveyance sensor that are originally provided for another purpose are diverted for determining whether or not the fixing unit is attached properly, so there are limitations when determining whether or not the fixing unit is attached properly using the typical technology such as described above. For example, in order to be able to perform determination using the typical technology described above, it is presumed that there is a released-pressure state between the fixing roller and the pressure roller at the time of attachment, and that there is no paper directly below the fixing roller and the pressure roller. Therefore, when the fixing unit is not in such a state beforehand, proper determination cannot be made, or when there is no paper, for example, an operation is necessary in order to drive the pressure roller and definitely set a state in which there is no paper directly below.

Therefore an inexpensive image forming apparatus that reduces wasteful operation and is capable of determining whether or not a fixing unit is attached properly is desired.

With the configuration according to the present disclosure described above, an inexpensive image forming apparatus that reduces wasteful operation and is capable of determining whether or not a fixing unit is attached properly can be obtained.

What is claimed is:

1. A image forming apparatus comprising:

an image forming apparatus main body; and a fixing roller that fixes a pattern composed of toner on paper by heating when conveying the paper on which the pattern is formed; and that uses a fixing unit that can be attached to and detached from the image forming apparatus main body; wherein a temperature sensor for detecting temperature of the fixing roller is provided in the fixing unit; and further comprises a control unit for determining after the fixing unit is attached whether or not the fixing unit is attached properly to the image forming apparatus main body according to a magnitude relationship between a temperature that is detected by the temperature sensor and a preset first threshold value; and wherein a main body side temperature sensor for detecting the temperature of the fixing roller when the fixing unit is attached is provided in the image forming apparatus main body; and the control unit, when, after the fixing unit is attached, the temperature detected by the temperature sensor becomes equal to or greater than the preset first threshold value, and the temperature detected by the main body side temperature sensor becomes equal to or greater than a preset second threshold value, determines that the fixing unit is attached properly to the image forming apparatus main body.

2. The image forming apparatus according to claim 1, wherein a pressure roller pressed against the fixing roller side and for nipping and conveying the paper between the fixing roller and the pressure roller is provided in the fixing unit, and the pressure between the fixing roller and the pressure roller is switched between two states: a normal state and a released-pressure state in which the pressure is lower than in the normal state;

switching between the normal state and the released-pressure state in the fixing unit is driven and performed from the image forming apparatus main body side; and a pressure-release sensor for detecting whether the state of the fixing unit is the normal state or the release-pressure state is provided in the fixing unit.

3. The image forming apparatus according to claim 1, further comprising a display unit that, when it is determined that the fixing unit is not attached properly, issues a warning indicating that the fixing unit is not attached properly.

4. The image forming apparatus according to claim 3, wherein when determining whether or not the fixing unit is attached properly to the image forming apparatus main body is continuously performed and it is continuously determined that the fixing unit is not attached properly, the display unit issues a warning indicating that there is an abnormality in the fixing unit.

5. A image forming apparatus comprising:

an image forming apparatus main body; and a fixing roller that fixes a pattern composed of toner on paper by heating when conveying the paper on which the pattern is formed; and that uses a fixing unit that can be attached to and detached from the image forming apparatus main body; wherein a temperature sensor for detecting temperature of the fixing roller is provided in the fixing unit; and further comprises a control unit for determining after the fixing unit is attached whether or not the fixing unit is attached properly to the image forming apparatus main body according to a magnitude relationship between a temperature that is detected by the temperature sensor and a preset first threshold value; and wherein a pressure roller pressed against the fixing roller side and for nipping and conveying the paper between the fixing roller and the pressure roller is provided in the fixing unit, and the pressure between the fixing roller and the pressure roller is switched between two states: a normal state and a released-pressure state in which the pressure is lower than in the normal state;

switching between the normal state and the released-pressure state in the fixing unit is driven and performed from the image forming apparatus main body side;

a pressure-release sensor for detecting whether the state of the fixing unit is the normal state or the release-pressure state is provided in the fixing unit;

when, after the fixing unit is attached to the image forming apparatus main body in one state of the normal state or released-pressure state and then the fixing unit is driven so as to be in the other state of the normal state and the released-pressure state, the pressure-release sensor detects that the state has become the other state, and when the temperature that is detected by the temperature sensor is equal to or greater than the first threshold value, the control unit determines that the fixing unit is attached properly to the image forming apparatus main body.

6. The image forming apparatus according to claim 5, wherein the one state is taken to be the normal state, and the other state is taken to be the released-pressure state.

7. The image forming apparatus according to claim 5, wherein a main body side temperature sensor for detecting the temperature of the fixing roller when the fixing unit is attached, and an outside-air temperature sensor for detecting the outside-air temperature are provided in the image forming apparatus main body; and the control unit, when the temperature detected by the outside-air temperature sensor becomes equal to or greater than a preset third threshold value, and when, after the fixing unit is attached, the temperature detected by the temperature sensor becomes equal to or greater than the first threshold value, and the temperature detected by the main body side temperature sensor becomes equal to or greater than a preset second threshold value, determines that the fixing unit is attached properly to the image forming apparatus main body.

8. The image forming apparatus according to claim 5, further comprising a display unit that, when it is determined that the fixing unit is not attached properly, issues a warning indicating that the fixing unit is not attached properly.

9. The image forming apparatus according to claim 8, wherein when determining whether or not the fixing unit is attached properly to the image forming apparatus main body is continuously performed and it is continuously determined that the fixing unit is not attached properly, the display unit issues a warning indicating that there is an abnormality in the fixing unit.

* * * * *